United States Patent [19]

Detert et al.

[11] 4,188,419

[45] Feb. 12, 1980

[54] METHOD FOR PREVENTING CRACKS BELOW SEAMS DURING PLATING AND WELDING

[75] Inventors: Klaus Detert, Neu-Isenburg; Wolfgang Bertram, Grossauheim; Hermann Fischdick, Neu-Isenburg, all of Fed. Rep. of Germany

[73] Assignee: Licentia Patent-Verwaltungs-G.m.b.H., Frankfurt, Fed. Rep. of Germany

[21] Appl. No.: 887,811

[22] Filed: Mar. 17, 1978

Related U.S. Application Data

[63] Continuation-in-part of Ser. No. 457,176, Apr. 2, 1974, abandoned, which is a continuation of Ser. No. 225,600, Feb. 11, 1972, abandoned.

[30] Foreign Application Priority Data

Feb. 12, 1971 [DE] Fed. Rep. of Germany ..... 2106600

[51] Int. Cl.[2] ..... C21D 9/50

[52] U.S. Cl. ..... 427/287; 427/383 C; 427/405; 228/231; 228/225; 148/127

[58] Field of Search ..... 29/487, 497, 488; 148/127; 228/231, 225; 427/287, 383 C, 405

[56] References Cited

U.S. PATENT DOCUMENTS 3,125,804 3/1964 Thome ..... 228/331

OTHER PUBLICATIONS

Linnert, George E., Welding Metallurgy, vol. 2, Carbon and Alloy Steels, 1967, pp. 141–188.

Nakamura et al, Stress-Relief Cracking in Heat-Affected Zone, Doc. #'s IIW-IX-648-69 and IIW-X-53-1-69 given at 1969 Meeting Int. Inst. of Welding, 30 pp.

*Primary Examiner*—Ralph S. Kendall

*Attorney, Agent, or Firm*—Spencer & Kaye

[57] ABSTRACT

A method for preventing the development of cracks below seams during the plating and welding of material by employing a heat source for producing local heating of the regions of the material adjacent the welding zone.

22 Claims, 5 Drawing Figures

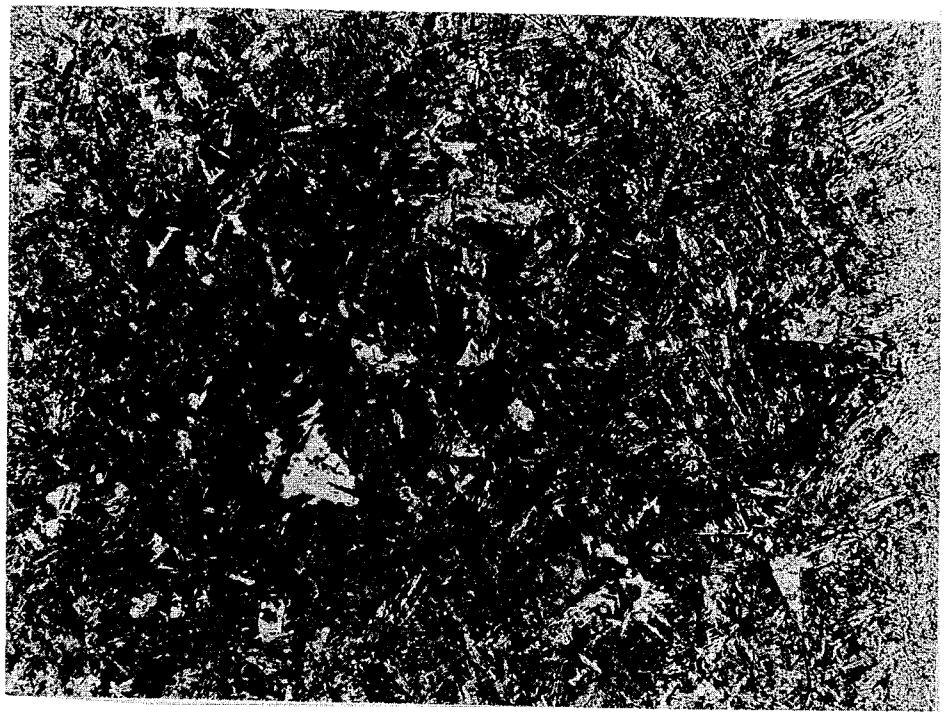
Figure 3 100:1

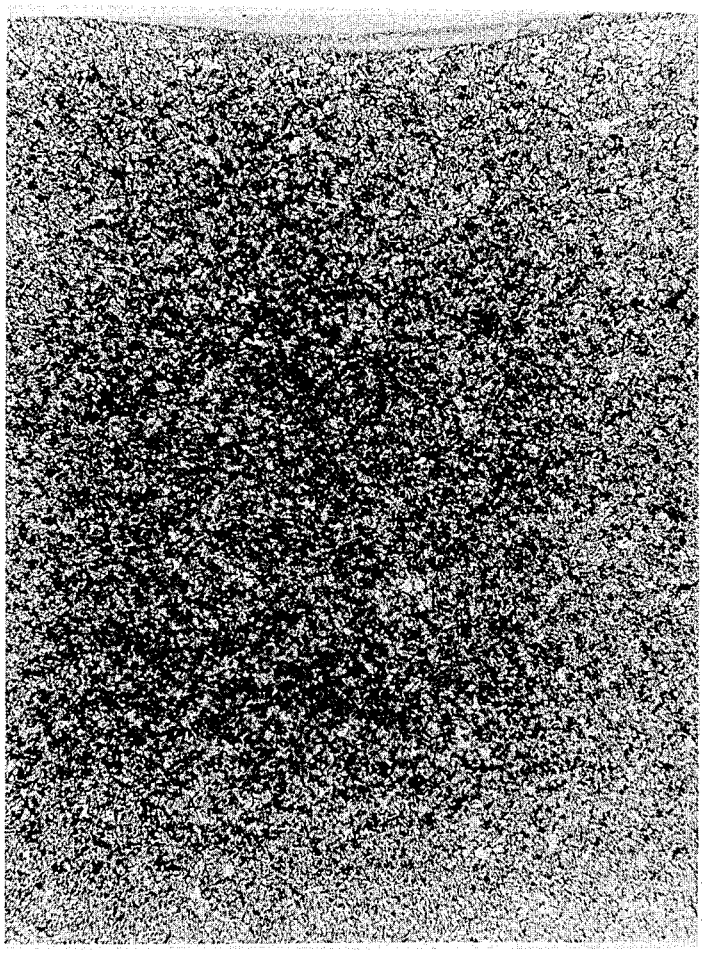
Figure 4 100:1
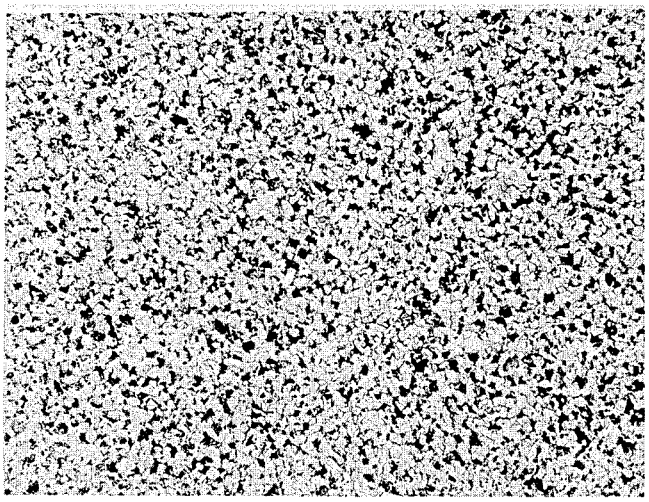
Figure 5 100:1

METHOD FOR PREVENTING CRACKS BELOW SEAMS DURING PLATING AND WELDING

CROSS-REFERENCE TO RELATED APPLICATION

This application is a continuation-in-part application of pending application Ser. No. 457,176, filed on Apr. 2nd, 1974, now abandoned, which itself is a continuation of application Ser. No. 225,600, filed on Feb. 11th, 1972, and now abandoned.

BACKGROUND OF THE INVENTION

The present invention relates to a method of plating and welding, and more specifically to a method for preventing the development of cracks below the seams during plating and welding.

During plating and welding of connections between low-alloy steels, fine cracks often occur in the heat-affected zones having a martensitic transformation structure. These zones are in the vicinity of the actual welding seam with the melt zone. Tests have shown that these cracks occur during stress relief annealing (approximately 600° C.). This phenomenon is known and is called "stress relief cracking", which is disclosed in Document No. IIW-IX-648-69, and Document No. IIW-X-531-69 given at the 1969 Meeting of International Institute of Welding with the title "Stress-relief cracking in heat-affected zone" by H. Nakamura, T. Naiki and H. Okabayashi, page 10.

It is also known that the martensitic transformation structure in which the occurrence of cracks is observed during stress relief annealing can be avoided by slow cooling. In the above-cited publications it is further stated that the occurrence of cracks during stress relief annealing can be avoided if a short-time annealing treatment occurs at approximately 900° C. after cooling and before the stress relief annealing so that the martensitic structure is refined by changing the size of its grains.

Both processes, however, cannot be used for welding structures without additional measures and do not bring about the desired result without additional restrictions during the heat treatment.

During a welding or plating treatment the material is heated locally to high temperatures so that rapid cooling occurs due to the heat dissipation to the surrounding areas. It is not the custom during such welding operations to provide slow cooling to the extent required to avoid crack formations. Otherwise the member would have to be heated to unduly high temperatures. Thus the individual parts are limited to preheating to temperatures of about a maximum of 200° C.

Subsequent heating of the welding seam to temperatures above the stress relief annealing temperature is also not practiced. Such an operation would lead to the desired result only if the heating were very rapid. Moreover, heating of the entire member would reduce the strength of tempered steels to below the prescribed values.

SUMMARY OF THE INVENTION

It is a general object of the present invention to produce this change in structure during the welding and plating process and thus eliminate the tendency to form cracks.

It is a more specific object of the present invention to provide a method of preventing cracks below seams during plating and welding by using a heat source in those areas adjacent the welding zone.

These and other objects are accomplished according to the present invention by the provision of a heat source for locally heating the regions adjacent to the welding zone.

The regions adjacent to the welding zone are understood to be all those regions of the material which extend to approximately 10 mm from the melt zone.

BRIEF DESCRIPTION OF THE DRAWINGS

FIG. 3 shows the microstructure, in a 100 times enlargement, in the base material of the workpiece in the heat-affected zones after welding but before the local heating of the present invention.

FIG. 4 shows the microstructure, in a 100 times enlargement, in the base material of the workpiece in the heat affected zones after welding and after the local heating of the present invention, but before stress relief heat treatment.

FIG. 5 shows the microstructure, in a 100 times enlargement, in a base material of a workpiece in the heat affected zones after welding and after a heating which was conducted outside the ranges of the present invention, but before stress relief heat treatment.

DESCRIPTION OF THE PREFERRED EMBODIMENTS

Figure 1:
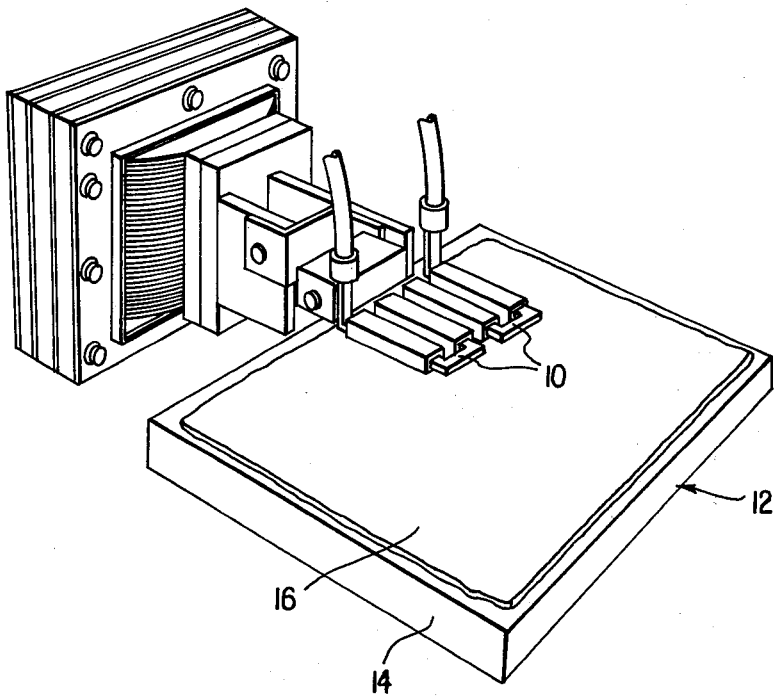
FIG. 1 is a perspective view showing a suitable apparatus for heating a workpiece in accordance with the method of the present invention.

The material may be preheated before the welding process to temperatures of preferably 600° C., but in any event to more than 400° C. The heating within this range may also take place directly after the welding process but before cooling.

The heat sources may be suitably designed burners, induction coils for medium and high frequency, radiation heating elements or direct current heating.

According to another embodiment of the present invention the material is heated after cooling but before the stress relief annealing to temperatures of preferably 900°-950° C., but in any event to above 700° C.

For this purpose heat sources are used which are suitable for local heating with rapid increase in temperature as those mentioned above. Subsequent heating of this type can also be produced by remelting the material, for example during a renewed plating or welding process, if it is assured that the subsequent heating of the heat-affected zone of the first weld exceeds 700° C., but does not exceed 950°-1000° C.

The present invention thus relates to a process for preventing crack formation in the base material underneath a weld during a stress relief heat treatment or annealing of weld claddings and connecting welds. The present invention achieves this result by subjecting the regions adjacent to and extending up to a maximum of about 10 mm from the welding zone to a local heating before the stress relief step. The local heating of the present invention is a heating which refers only to the melt zone, and to a penetration depth up to no more than about 10 mm into the base material. As used herein, the term "welding zone" refers to the melt zone formed during the welding operation. In one embodiment of the invention, the local heating can occur at a temperature of from above 700 up to 1000° C., preferably 900° to 950° C., after cooling of the weld, but before stress relief heat treatment. In a second embodiment of the present invention, the local heating can occur at a temperature of from 400° to 600° C., preferably 600° C., either before the welding operation or after the welding operation, but before the welding zone has cooled.

The workpieces with which the present invention is concerned are those in which stress relief cracking is a problem. As is well known in the welding art, after welding, the welded structure is often reheated to an elevated temperature. The most common reason for a reheating treatment is for thermal stress relief. With thick structures, generally made of a material which is capable of precipitation, cracks often occur during the reheating after welding, and this phenomenon has been referred to as stress relief cracking. The problem generally is not present with relatively thin structures and is generally associated with the use of materials other than plain carbon steels. The stress relief cracking generally occurs in the heat-affected areas which are formed in the base material during the welding operation and generally does not occur in the the weld metal. The workpieces which are subject to stress relief cracking generally have a thickness of at least about 30 mm and higher, such as about 55 mm, or about 150 mm, or more. The workpieces generally are of large dimension for large structures such as large size nuclear reactor components and pressure vessels.

Referring now to the drawings, FIG. 1 shows an inductive heating system, including a heating head 10 in the form of a stationary inductor and a workpiece in the form of a weld-plated plate 12 which is mounted for movement thereunder. Plate 12 is moved, for example, in the direction of the arrow.

Weld-plated plate 12 is comprised of a substrate of a base material 14 and a weld-plated cladding layer 16 formed by a plurality of adjacent welding beads. Each welding bead generally has a length which is substantially greater than its width. The width of each welding bead can be, for example, about 60 mm and its thickness can be, for example, about 6 mm. The length of the welding bead can be many times greater and, for example, can be 5 to 10 or more times greater than its width.

Figure 2:
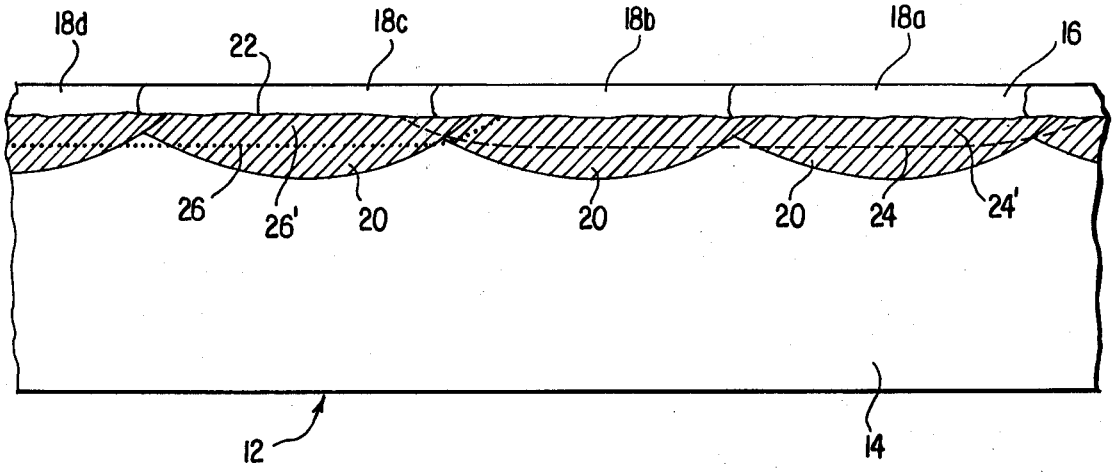
FIG. 2 is a cross-sectional view through a portion of the workpiece shown in FIG. 1, after the workpiece has been subjected to the local heating of the present invention, but before the stress relief heat treatment.

Turning now to FIG. 2, which is a microcut through a portion of plate 12, and taken perpendicular to the longitudinal direction of the welding beads, there is shown four adjacent welding beads 18 (*a,b,c* and *d*) which correspond to the welding zone formed during the welding operation. Underneath each welding bead 18, there is an area, shaded for purposes of clarity, which is the heat affected area or zone formed by the welding operation in the base material 14. These heat-affected areas 20 are the areas which are subject to stress relief cracking.

In accordance with the present invention, the heat-affected areas 20 formed by the welding are subjected to a local heating to a depth of no more than 10 mm. This depth of local heating is measured from the transition point 22 between the base material 14 and the welding bead 18 and thus defines the regions adjacent to and extending up to no more than 10 mm from the welding zone. This depth is shown in FIG. 2 by dashed line 24 and dotted line 26 which define a heat influence zone 24' and 26' in the heat-affected areas 20 of welding beads 18. The heat influence zone produced by the local heating has a fine grained structure and as a result stress relief cracking does not form when the so treated plate is subjected to a stress relief heat treatment. In the embodiment shown in FIG. 2, the heat influence zone produced by the local heating does not extend to the full depth of the heat-affected areas 20. The maximum that the local heating of the present invention can extend is 10 mm from the welding zone, that is, from transition point 22, and can, for example, extend to no more than 4 or 5 mm from the welding zone. In the present invention, the heat affected areas formed by the welding operation are subjected to the local heating.

The local heating of the present invention is produced by directing heat through the welding beads 18 and into the heat-affected areas 20 of the welding beads. The local heating of the present invention must be such that each portion of the heat-affected areas 20 which is subjected to local heating is heated for only a short period of time which is sufficient to bring the locally heated areas to the desired temperature of, for example, 900° C. Thus, each portion of the heat-affected areas 20 which is locally heated is heated for from about 50 to 100 seconds until the desired temperature is reached, and then is no longer subjected to the local heating. This type of local heating is achieved by continuously moving the local heating source relative to the workpiece and by using a local heating source which directs its heat substantially uniformly only to a specified or controlled region.

A suitable local heating source for this purpose is the heating head 10 in the form of a stationary conductor which is positioned a short distance, such as 4 mm, from the workpiece. Such a heating head 10 directs its heat downwardly in an area corresponding to its outline or perpendicular projection and thus provides a local heating, i.e. only in the region of its outline.

The refinement in grain structure brought about by the local heating of the present invention can be seen by a comparison of the microstructures shown in FIGS. 3 and 4. FIG. 3 shows the microstructure in the heat-affected areas 20 of the base material 14 of workpiece 12 of FIGS. 1 and 2 after welding and cooling, but before the local heating. As can be seen from FIG. 2, this structure shows no cracks yet, but it has high inherent tensile stresses. If the structure shown in FIG. 3 is stress relief heat treated, cracks can appear. FIG. 4 shows the microstructure of the base material 14 after welding and cooling, and after it has been subjected to the local heating of the present invention to a temperature of 900° C. The local heating produced a heat influence zone 24' and 26' which penetrated to about 5 mm into the base material 20, and FIG. 4 shows the microstructure in the heat influence zone.

As can be seen very clearly in FIG. 4, after the local heat treatment, the structure is much finer than it was after welding (FIG. 3). The regrained structure according to FIG. 4 is now so fine-grained that in spite of the inherent tensile stresses which the local heat treatment also did not eliminate, these stresses can now be removed during the stress relief heating without the formation of cracks.

If the about 900° C. heat treatment is expanded to areas larger than about 10 mm of base material 14, and for a longer period of time, a structure as shown in FIG. 5 results. The structure shown in FIG. 5, after welding, had been heated to 860° C. for 10 minutes. As can be seen in FIG. 5, such a heating produces a normalization structure which shows no crack formation, but the stability of the base material has dropped significantly below the minimum values prescribed by the material specification. Also the planting could have brittled to a significant extent and would be subject to intercrystalline corrosion.

If the local heating is controlled so that it is kept at up to 10 mm this undesirable structure is not produced. The structure according to FIG. 5 occurs quite generally when the holding time at the local heating temperature is extended significantly beyond the above-mentioned times of 50 to 100 seconds used in the present invention. If, for example, a temperature of 900° C. is held for 10 minutes, the heated regions are generally much larger than the 10 mm heat influenced zones produced in the present invention.

It should also be noted that if the heating time is greater, the cooling speed is then comparably slower. The result is the normalization structure shown in FIG. 5, which is lacking in stability.

In the practice of the present invention, before weld plating, base material 14 can be preheated in a conventional manner to about 150° C., is then weld plated, and in the embodiment where there is cooling, is then allowed to cool to ambient temperature. After cooling, the weld-plated plate 12 is introduced into the system of FIG. 1 to be locally heated at about 900° C. Due to the continuous relative movement between heading head 10 and weld plate 12, each portion of the heat affected zones are locally heated for only a short period of time. Rapid heating is a prerequisite for the heating of local regions according to the present invention.

In the present invention, the heating speed takes about 50 to 100 seconds to reach a temperature of 900° C. The heating is local, i.e. only in the region of heating head 10 and the head 10 and the workpiece continuously move with respect to one another. The advancing speed of heating head 10 preferably is about 100 mm/min.

Heating head 10 is moved relatively rapidly over welding beads 18 in their longitudinal direction, and preferably covers a plurality of beads 18. In the embodiment shown in FIG. 2, the heating head 10 covers two adjacent welding beads 18*a* and 18*b*, that is, it extends completely over the width of two welding beads 18*a* and 18*b*. Preferably, the heating head 10 overlaps a portion of the next adjacent welding bead 18*c*. Heating head 10, as shown in FIG. 1, covers a relatively small portion of the length of the welding beads and thus must be relatively moved in the longitudinal direction of the welding beads to bring about the desired local heating of the heat affected zones produced by the welding operation. During a first pass of heating head 10 with respect to the workpiece in the longitudinal direction of the welding beads, a heat influenced zone is formed which is defined by dashed 24'. After the first pass, heating head 10 is relatively moved in a direction perpendicular to the longitudinal direction of the welding beads so that it now completely covers welding bead 18*c* and the next adjacent welding bead 18*d*.

Heating head 10 is moved in this perpendicular direction so that is partially overlaps welding bead 18*b*. Heating head 10 is then relatively moved in the longitudinal direction of the welding beads during a second pass to form a heat influenced zone defined by dotted line 26'. Heat influence zones 24' overlaps heat influence zone 26' to insure that all regions of the heat affected zones 20 are covered by the local heating of the present invention. Thus, the longitudinal passes of the heating head 10 overlap each other. While the heating head 10 used in the embodiment of FIG. 2, completely covers the width of two welding beads, the heating head can be designed to cover more welding beads. Thus, for example, it is possible to provide a heating head which completely covers the width of four welding beads.

It is noted that the above referred to Nakamura et al reference, quite generally discloses the regraining of the structure in conjunction with small samples which are heated in their entirety to about 900° C. The method of Nakamura et al, however, cannot be used for large items because if the entire large component is heated, cracks may occur already during the relatively slow initial heating period. Further, the heating of the entire large component will result in the normalization structure according to FIG. 5, with the above-described drawbacks of the much reduced stability. It is known that during stress relief heating after welding, cracks are formed at about 600° C. due to the high inherent tensile stresses occurring after welding. Thus, to go to temperature around 900° C. when large components are involved was not expected to provide acceptable results because the critical range of 600° C. in which the crack formation occurs would inevitably have to pass through. The process of Nakamura et al can be used for small samples to avoid the formation of cracks during stress relief welding, but this process was not expected to provide satisfactory results for large components since it was expected that cracks will occur when the 600° C. range is passed because the high inherent tensile stresses which occur after welding were expected to lead to the cracks during passage of the 600° C. range.

The present invention, however, has surprisingly found that no cracks occur if the heating is controlled to provide a local heating in the heat affected zones formed during the welding operation. Tests have shown that with rapid local heating according to the present invention the inherent tensile stresses present after welding were reversed to inherent pressure stresses, and therefore no cracks are formed when the temperature is raised to 600° C. and above, i.e. at the moment of passage through the 600° C. zone no inherent tensile stresses are present, only inherent pressure stresses. This phenomenon is completely surprising and could not be predicted. In the embodiment of the invention where the weld is not cooled before the local heating according to the present invention, the resulting structure will be similar to that of FIG. 4, but the ductility of the structural regions in the corresponding heat influence zone formed by the local heating will be higher than after welding without the local heat treatment according to the invention. Due to the increased ductility, the crack formation is prevented during subsequent stress relief heating.

The following examples are given by way of illustration to further explain the principles of the invention. These examples are merely illustrative and are not to be understood as limiting the scope and underlying principles of the invention in any way. All percentages referred to herein are by weight unless otherwise indicated.

EXAMPLE I

Induction heating on weld cladding, 1 - layered base metal: ASTM A 508 Cl.2
thickness of sheet: 145 mm
weld cladding metal: AISI 308 L
thickness of cladding: 6 mm -continued Welding parameters:

| | | |
|---|---|---|
| preheating temperature: | | none |
| welding method: | | submerged arc, surfacing with strip electrodes |
| strip dimensions: | | 60 × 0.5 mm |
| powder: Ellira 10, | producer: | Fa. Linde AG 8044 Lohhof/Munchen, C. V. Lindestr. West Germany |
| welding current: | | 590–630 A |
| welding voltage: | | 28–30 V |
| welding rate: | | 10 cm/min |

Induction heating after cooling to room temperature medium frequency - induction heating equuipment consisting of:
1 - phase medium frequency converter
power: 50 kW
voltage: 600 V
frequency: 10 kHz
inductor: meander - shaped
overall dimensions: 90 × 120 mm
distance inductor/cladding surface: about 4 mm
feed of the inductor: 10 cm/min
guidance of the inductor: parallel to the weld bead
depth of the crack - sensitive zone from the surface: 6–10 mm
maximum temperature:
on the surface: 1135° C.
at the transition cladding/base metal (6mm from the surface): 1050° C.
in a depth of 10 mm from the surface: 800° C.
heating time: 100 sec.
cooling time to 200° C.: about 6 min.

Stress relief annealing heating rate: about 50° C./h
annealing time: 16 h at max. 610° C.
cooling: furnace-cooled
Result after induction heating and subsequent stress relief annealing: no cracks
Result without induction heating but after stress reilef annealing: in the region of the overlapping in the heat affected zone of the base metal numerous intercrystalline cracks transversal to the welding direction of max. 10 mm length and max. 2 mm depth.

EXAMPLE II

| | 2 - layer weld cladding |
|---|---|
| base metal: | ASTM A 508 Cl.2 |
| weld cladding metal: | AISI 308 L |
| thickness of cladding: | 1st layer: about 3.5 mm<br>2nd layer: about 5 mm |

welding parameters:
as in Example I, but
welding rate: 1st layer: 16 cm/min
2nd layer: 11 cm/min
Stress relief heat treatment and annealing
as in Example I
Result: no cracks It will be understood that the above description of the present invention is susceptible to various modifications, changes and adaptations, and the same are intended to be comprehended within the meaning and range of equivalents of the appended claims.

What is claimed is:

1. Method for preventing crack formation during stress relief annealing of weld claddings and connecting welds, comprising: conducting a welding operation, cooling the welding zone and adjacent regions after the welding operation, locally heating the regions adjacent to and extending up to a depth of no more than about 10 mm from the welding zone to temperatures of from about 700° C. and up to 1000° C. after the welding zone and adjacent regions have cooled and before the stress relief annealing of said welding zone and adjacent regions, thereby refining the coarse grained structure in said regions before the said stress relieving step, and then stress relief annealing said welding zone and adjacent regions after the local heating.

2. Method as set forth in claim 1 wherein the local heating is at a temperature of from 900° to 950° C.

3. Method as set forth in claim 1 wherein the regions are adjacent a weld cladding and are locally heated, after cooling, by welding a second cladding layer.

4. Method for preventing crack formation during stress relief heat treatment of a workpiece containing weld claddings and connecting welds, comprising: conducting a welding operation, cooling the welding zone and adjacent regions after the welding operation, locally heating the regions adjacent to and extending up to a depth of no more than about 10 mm from the welding zone to temperatures of from about 700° C. and up to 1000° C. after the welding zone and adjacent regions have cooled and before the stress relief heat treatment of said welding zone and adjacent regions by heating the said regions for a time of from 50 to 100 seconds, thereby refining the coarse grained structure in said regions before the said stress relieving step, and then stress relief heat treating said welding zone and adjacent regions after the local heating.

5. Method as set forth in claim 4 wherein the local heating is at a temperature of from 900° to 950° C.

6. Method as set forth in claim 4 wherein the regions are adjacent a weld cladding and are locally heated, after cooling, by welding a second cladding layer.

7. Method as defined in claim 1 wherein the local heating is effected by relatively moving a heat source with respect to the workpiece.

8. Method as defined in claim 4 wherein the weld zone is comprised of a longitudinally extending welding bead, and the local heating is effected by relatively moving a heat source with respect to the workpiece in the longitudinal direction of the welding bead.

9. Method as defined in claim 4 wherein the weld zone is a weld cladding comprised of a plurality of adjacent longitudinally extending weld beads, and the local heating is effected by relatively moving a heat source with respect to the workpiece in the longitudinal direction of the beads.

10. Method as defined in claim 9 wherein the heat source heats at least two adjacent weld beads during a first pass of the heat source over the workpiece.

11. Method as defined in claim 10 wherein a second pass of the heat source over the workpiece heats additional adjacent weld beads.

12. Method as defined in claim 11 wherein the second pass overlaps the first pass.

13. Method for preventing crack formation during stress relief annealing of weld claddings and connecting welds, comprising: conducting a welding operation, locally heating the regions adjacent to and extending up to about 10 mm from the welding zone to temperatures of above 400° C. and up to 600° C., said local heating occurring just before the welding operation or after the welding operation but before cooling of the welding zone and adjacent regions, said local heating occurring before the stress relief annealing of said welding zone and adjacent regions, to thereby refine the coarse grained structure in said regions before the said stress relieving step, and then stress relief annealing said welding zone and adjacent regions after the welding operation.

14. Method as set forth in claim 13 wherein the local heating is at a temperature of 600° C.

15. Method for preventing crack formation during stress relief heat treatment of a workpiece containing weld claddings and connecting welds, comprising: conducting a welding operation, locally heating the regions adjacent to and extending up to a depth of no more than about 10 mm from the welding zone to temperatures of above 400° C. and up to 600° C. by heating the said regions for a time of from 50 to 100 seconds, said local heating occurring just before the welding operation or after the welding operation but before cooling of the welding zone and adjacent regions, said local heating occurring before the stress relief heat treatment of said welding zone and adjacent regions, to thereby refine the coarse grained structure in said regions before the said stress relieving step, and then stress relief heat treating said welding zone and adjacent regions after the welding operation.

16. Method as defined in claim 15 wherein the local heating is at a temperature of 600° C.

17. Method as defined in claim 15 wherein the local heating is effected by relatively moving a heat source with respect to the workpiece.

18. Method as defined in claim 15 wherein the weld zone is comprised of a longitudinally extending welding bead, and the local heating is effected by relatively moving a heat source with respect to the workpiece in the longitudinal direction of the welding bead.

19. Method as defined in claim 15 wherein the weld zone is a weld cladding comprised of a plurality of adjacent longitudinally extending weld beads, and the local heating is effected by relatively moving a heat source with respect to the workpiece in the longitudinal direction of the beads.

20. Method as defined in claim 19 wherein the heat source heats at least two adjacent weld beads during a first pass of the heat source over the workpiece.

21. Method as defined in claim 20 wherein a second pass of the heat source over the workpiece heats additional adjacent weld beads.

22. Method as defined in claim 21 wherein the second pass overlaps the first pass.

* * * * *